US005199555A

United States Patent [19]

Hirano

[11] Patent Number: 5,199,555

[45] Date of Patent: Apr. 6, 1993

[54] PUSH BUTTON SWITCH

[75] Inventor: Kouichi Hirano, Iwaki, Japan

[73] Assignee: Alps Electric Co., Ltd., Tokyo, Japan

[21] Appl. No.: 839,638

[22] Filed: Feb. 21, 1992

[30] Foreign Application Priority Data

Feb. 22, 1991 [JP] Japan ..... 3-048789

[51] Int. Cl.[5] ..... H01H 13/14; H01H 13/04

[52] U.S. Cl. ..... 200/341; 200/517; 200/520; 200/5 A; 200/345

[58] Field of Search ..... 200/345, 341, 517, 520, 200/406, 5 A

[56] References Cited

U.S. PATENT DOCUMENTS

| | | | |
|---|---|---|---|
| 3,952,174 | 4/1976 | Boulanger et al. | 200/5 A |
| 4,331,851 | 5/1982 | Johnson | 200/517 |
| 4,493,959 | 1/1985 | Viebrantz | 200/345 X |
| 4,638,151 | 1/1987 | Suwa | 200/517 |
| 4,803,321 | 2/1989 | Lefebvre | 200/517 |
| 5,055,642 | 10/1991 | Miyata . | |

FOREIGN PATENT DOCUMENTS

| | | | |
|---|---|---|---|
| 0258325 | 10/1989 | Japan | 200/406 |
| 0089421 | 4/1991 | Japan | 200/520 |

*Primary Examiner*—Ernest G. Cusick

*Attorney, Agent, or Firm*—Guy W. Shoup; Norman R. Klivans

[57] ABSTRACT

A push button switch has a stem having a thin flange without requiring fabrication of synthetic material, thereby realizing a push button switch having good productivity and high reliability. To this end, a push button switch has a housing (10) having an opening, a fixed contact (17) exposed on the inner bottom surface, a movable contact (13) disposed to face said fixed contact (17), a stem (15) having a flange portion around its main body and being mounted on the housing (10) movably in an up-and-down direction, the movable contact (13) being contacted with the fixed contact (17) when said stem (15) is lowered, and the stem (15) being formed by a first metallic material (21) and a second metallic material (22), the first metallic material (21) having a through hole (21*a*) surrounded by a tapered surface (21*b*) and chiefly constituting the flange portion of the second metallic material (22) being press-fitted into the through hole (21*a*) on the first metallic material (21) so as to be press-fixed on the tapered surface (21*b*) of the first metallic material (21) through press processing.

7 Claims, 3 Drawing Sheets

PUSH BUTTON SWITCH

BACKGROUND OF THE INVENTION

1. Field of the Invention

The present invention relates to a small and thin push button switch, particularly to its stem.

2. Description of the Related Art

A stem assembled in a push button switch has a combined configuration of a main body and its surrounding flange. The stem is mounted on a housing so that the stem is movable through an opening of the housing in an up-and-down direction. Such a stem serves to push down a movable contact to contact with a fixed contact disposed so as to face a movable contact. The fixed contact is exposed on a bottom surface of the housing. Generally, a stem 1 is made of synthetic resin, and consists of a flange portion 1*a* and a main body 1*b* integrated together, as shown in FIG. 8.

As another example of the stem, as shown in FIG. 9, there is known a stem 2 consisted of a metallic flange made by a metallic plate 3 having a through hole 3*a*, and a synthetic resin main body 4.

However, in order to promote reduction of the thickness of the small push button switch, reducing the thickness of flange accomplishes this purpose. In the case that the stem 1 is made of only synthetic resin as shown in FIG. 8, it is difficult to reduce the thickness of the flange 1*a*, since melted synthetic resin cannot be smoothly filled in a thin cavity during molding.

On the other hand, though the stem 2 shown in FIG. 9 has a thin metallic flange, manufacturing steps for obtaining the stem 2 are complicated. Namely, it is necessary, first of all, to obtain a metallic plate 3 pressed into a flange configuration. Next, this metallic plate 3 is inserted in dies to obtain the main body 4 of synthetic resin material associated with the metallic plate 3. That is, it requires two manufacturing steps, and production efficiency is low.

Furthermore, this stem 2 has a poor thermal durability, since the metallic plate 3 and the synthetic resin main body 4 have different thermal expansion coefficients. Thus, it is feared that the metallic plate 3 comes out of from the synthetic resin main body 4. In addition, there is a problem such that traces of injection gates; i.e. projections, are formed on the surface of the synthetic resin main body 4. As a result, reliability of stem 2 is low.

SUMMARY OF THE INVENTION

It is therefore an object of the present invention, in order to resolve the aforementioned problems and disadvantages encountered in the art, to provide an improved push button switch having reduced thickness of the flange of the stem and increasing the productivity or the reliability of the stem.

To this end, according to the present invention, there is provided an improved stem comprising a first metallic material constituting chiefly a flange, said first metallic material having a through hole surrounded by a tapered surface, and a second metallic material constituting chiefly a main body of the stem, said second metallic material being made of a softer material, and said second metallic material being press-fitted into the through hole so as to be press-fixed onto the tapered surface of the first metallic material.

In accordance with the present invention, the stem itself is made of only metallic materials. Thus, the thickness of the flange portion of the stem is thin. And, thermal durability is not likely to be worsened due to largely different thermal expansion coefficients, and reliability of the stem is not likely to be lowered due to the remaining traces of injection gates. Moreover, the above stem in accordance with the present invention can be manufactured easily in only one manufacturing step. That is, the second metallic material being press-fitted into the through hole of the first metallic material is processed through single press processing.

The above and other objects, features and advantages of the present invention will become apparent from the following detailed description which is to be read in conjunction with the accompanying drawings.

BRIEF DESCRIPTION OF THE ACCOMPANYING DRAWINGS

DETAIL DESCRIPTION OF THE PREFERRED EMBODIMENT

Figure 1:
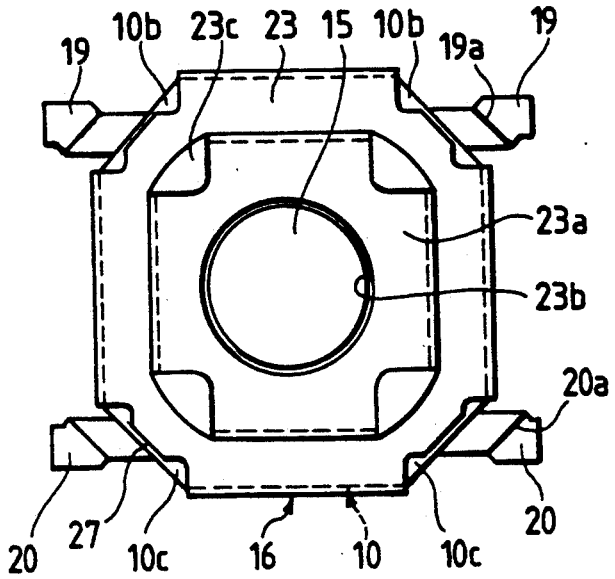
FIG. 1 is a plane view showing a push button switch in accordance with a preferred embodiment of the present invention.

Hereinafter, referring now to FIGS. 1 to 7, a preferred embodiment of the present invention is explained in more detail. In the drawings, a push button switch is a small type, which has an essentially square configuration being around 5 mm in width and 1.5 mm in thickness. The push button switch has a housing 10, which is octagonal in configuration when seen from the top.

The push button further comprises a pair of belt-like metallic plates 11 and 12 each extending in parallel with each other. These pair of belt-like metallic plates 11 and 12 are inserted into the molding dies at the same timing the housing 10 is molded. There is also provided a movable contact 13 which is formed in a dome-shape and is accommodated in the housing 10. A dust cover sheet 14 is provided on an opening 10*a* of the housing 10 to cover the opening 10*a* so as to prevent dust from entering. The dust cover 14 is made of flexible material.

There is further provided a stem 15 located over the dust cover 14. That is, through the dust cover 14, the stem 15 pushes the movable contact 13 to move together downward when it is forced to cause a downward movement. Still further, the push button switch comprises a frame body 16, which fixedly presses the periphery portion of the dust cover 14 and is secured to the housing 10 so that the stem 15 can be inserted therethrough.

The housing 10 is about 0.65 mm in thickness, and its four corner portions are rounded off. Therefore, its maximum outer radius is shorter than that of a square-shaped housing having an equivalent width, if compared.

Figure 2:
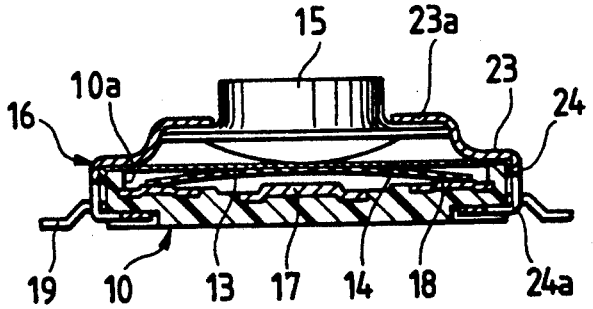
FIG. 2 is a cross-sectional view of the push button switch shown in FIG. 1.
Figure 3:
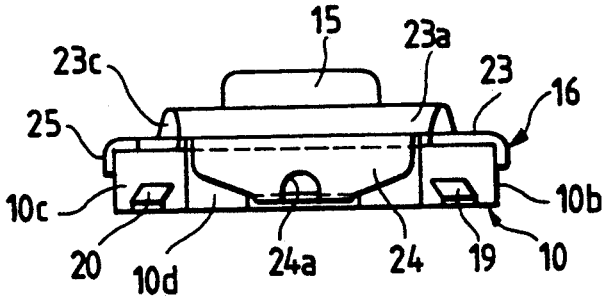
FIG. 3 is a side view of the push button switch shown in FIG. 1.
Figure 4:
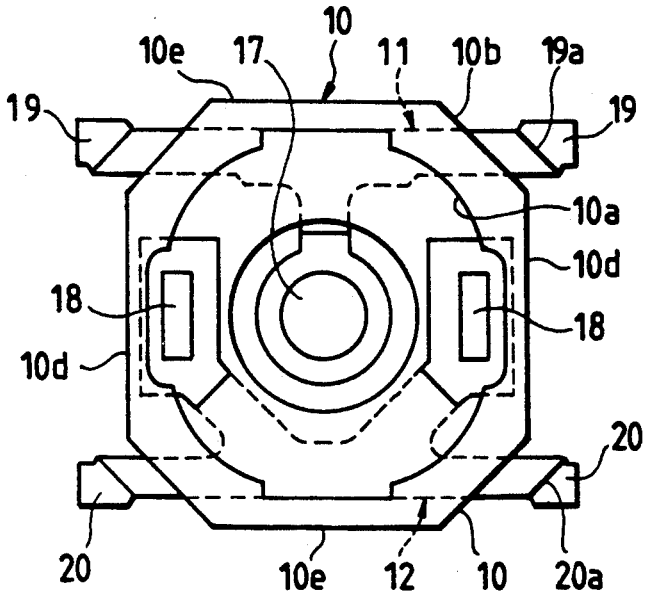
FIG. 4 is a plane view showing a housing applied to the push button switch in accordance with the present invention.

As is apparent from FIGS. 2 and 4, at an inner bottom surface of the housing 10, there are exposed a pair of a central fixed contacts 17 and a circumferential fixed contact 18 so as to be spaced apart from each other. The central fixed contact 17 is made of a part of the belt-like metallic plate 11, while the circumferential fixed contact 18 is made of a part of the other belt-like metallic plate 12. Both end portions of the belt-like metallic plate 11 are formed in a shape so as to serve as a terminal 19, respectively.

Each of the terminals 19 protrudes from the rounded-off portion 10*b* provided on each side of the housing 10 and extends toward an opposite direction from the other. One end of the terminal 19 is supported in the outer wall surface of the housing 10; i.e. the rounded off portion 10*b*. Each terminal 19 has a stepped portion 19*a* which is formed by being bent in a cranked-shape along the rounded-off portion 10*b*.

A distal end of respective terminal 19 protruding from each stepped portion 19*a* serves as a soldering part. That is, this soldering part is soldered at a predetermined position of a printing circuit pattern substrate.

In the same way, both end portions of the belt-like metallic plate 12 are formed in a shape so as to serve as a terminal 20, respectively.

Each of the terminals 20 protrudes from the rounded-off portion 10*c* provided on each side of the housing 10 and extends toward an opposite direction from each other. One end of the terminal 20 is supported on the outer wall surface of the housing 10; i.e. the rounded-off portion 10*c*. Each terminal 20 has a stepped portion 20*a* which is formed by being bent in a cranked-shape along the planed-off portion 10*c*.

A distal end of respective terminal 20 protruding from each stepped portion 20*a* serves as a soldering part. That is, this soldering part is soldered at a predetermined position of a printing circuit pattern substrate.

The movable contact 13 is known as a so-called reversal switch, which causes a click feeling when pushed a predetermined amount and turned from side to side. When the pushing force applied thereon is removed, this movable switch 13 restores to its original dome-shaped configuration. This movable contact 13 is mounted on the circumferential fixed contact 18 in the housing 10 so that a central portion of the movable contact 13 can be contacted with the central fixed contact 17.

The dust cover sheet 14 is adhesively fixed on an upper edge surface of the housing 10 so as to conceal the opening 10*a*. That is, the dust cover sheet 14 serves to prevent the central fixed contact 17 and the movable contact 13 from being contaminated by entering dust. Namely, if dust enters into a gap between the central fixed contact 17 and the movable contact 13, it is feared to cause a failure in conductivity between these contacts 17 and 13. Accordingly, the contact portion of the push button switch is concealed by the dust cover sheet 14 in advance. Thus, it can be guaranteed to prevent dust from entering and causing trouble.

The stem 15 consists of two integrated metallic materials, which are a pair of a hard and a soft metallic materials. In detail, the stem 15 is constituted of a first metallic material 21 and a second metallic material 22. The first metallic material 21 has a through hole 21*a* at a center thereof. There is formed a tapered surface 21*b* in the periphery of the through hole 21*a*. The first metallic material 21 chiefly serves as a flange, and is stainless steel.

On the other hand, the second metallic material 22 is relatively soft metallic material such as a brass. The second metallic material 22 is to be press-fitted into the through hole 21*a* to constitute a main body of the stem 15.

Figure 5A:
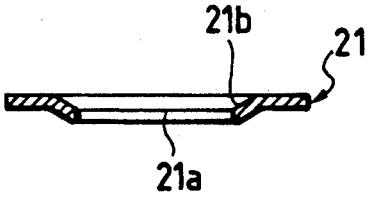
FIG. 5 is a view showing manufacturing steps of a stem adopted for the push button in accordance with the present invention.
Figure 5B:
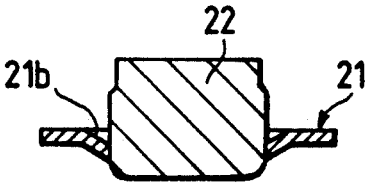
Figure 5C:
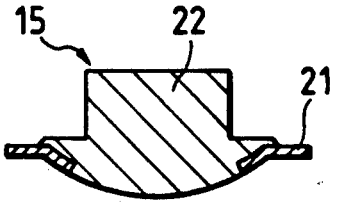

Now, manufacturing steps of the stem 15 are explained by referring to FIG. 5. First of all, as shown in FIG. 5(*a*), the first metallic material 21 is cut into a predetermined configuration in advance. Then in this step, the first metallic material 21 is processed through a stamping operation. As a result of this stamping operation, the first metallic material 21 is finished into a flange-shaped metallic plate having the through hole 21*a* surrounded by the tapered surface 21*b*.

Next, as shown in FIG. 5(*b*), the second metallic material 22 is stamped out as a caulking ball in advance. And, in this step, the second metallic material 22 is press-fitted into the through hole 21*a*, and subsequently, is processed by a press operation. With this press operation, the second metallic material 22 protrudes with a curved surface from the through hole 21*a*. The second metallic material 22 itself is press-fixed on the tapered surface 21*b*. At the same time, the body of the second metallic material 22 is formed in a predetermined configuration. Thus, the first and the second metallic materials 21 and 22 are integrated to form a predetermined-shaped stem 15.

Thus obtained stem 15 is, as shown in FIG. 2, mounted on the movable contact 13 through the dust cover sheet 14. Therefore, the stem 15 is held movable in an up-and-down direction with respect to the housing 10. On the other hand, the frame body 16 described in detail later fixes the flange portion of the stem 15. Thus, the uppermost position of the stem 15 reachable in its vertical stroke is restricted by the frame body 16. Accordingly, the stem 15 will not accidentally fall out of the housing 10.

Figure 7:
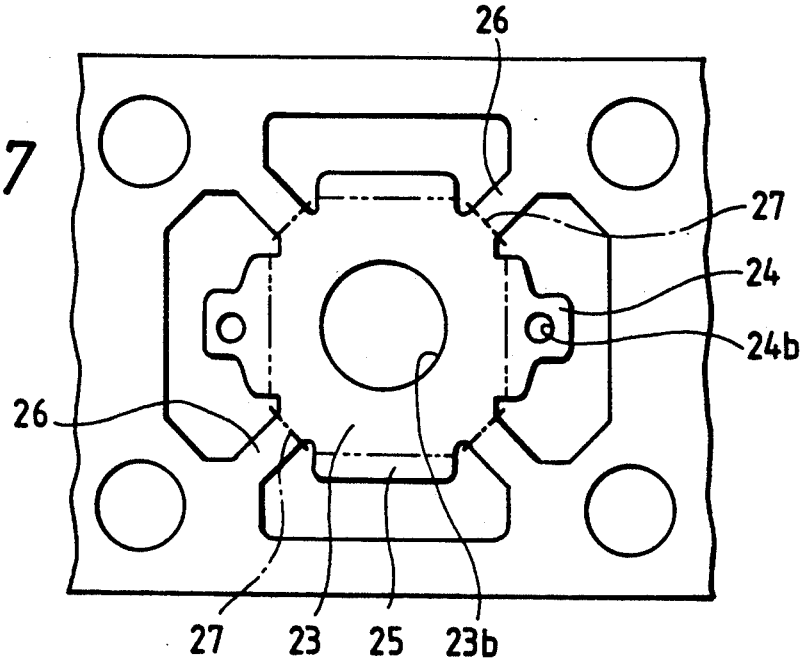
FIG. 7 is a plane view showing the frame body shown in FIG. 6 which is still in a hoop.
Figure 8:
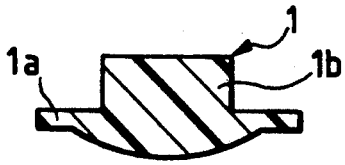
FIG. 8 PRIOR ART
FIG. 8 is a cross-sectional view showing a stem adopted in a conventional push button switch.
Figure 9:
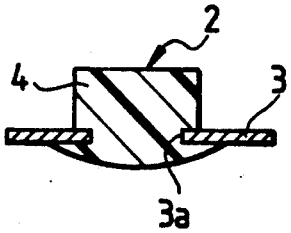
FIG. 9 PRIOR ART
FIG. 9 is a cross-sectional view showing another example of the stem applied in a conventional push button switch.

The frame body 16 is manufactured into the configuration as shown in FIG. 7 by punching a hoop-shaped metallic plate. This frame body 16 is fixedly mounted on the housing 10 through the dust cover sheet 14 so as to cover the opening 10*a*. That is, this frame body 16 has substantially the same configuration as the housing 10 when seen from the top.

And further, the frame body 16 comprises a cover plate portion 23 disposed on the dust cover sheet 14, a pair of first leg pieces 24 each elongated from opposite left or right side edges of the cover plate portion 23 and bent along the outer wall surface 10*d* and the bottom surface of the housing 10, and a pair of second leg pieces 25 each elongated from opposite upper or lower side edges of the cover plate portion 23 and bent along the outer wall surface 10*e* and the bottom surface of the housing 10. The directions applied in the above explanation are defined in accordance with FIG. 7.

In the cover plate portion 23, there is formed a protruding portion 23*a* formed into a slightly small octagonal shape through a drawing process. At a center of this protruding portion 23*a*, there is formed a penetrating hole 23*b* for inserting the main body of the stem 15. Moreover, as apparent from FIGS. 2 and 3, on the first leg piece 24 that is formed into a relatively long shape, there is provided a through hole 24a. This through hole 24a is located at a predetermined position corresponding to the corner portion extending from the outer wall surface 10d to the bottom surface of the housing 10. This is to facilitate folding the first leg piece 24 at both sides of the through hole 24a. By this arrangement, the first leg piece 24 can be bent along the housing in such a manner that the tip end of the first leg piece 24 is engagedly fixed on the bottom surface of the housing 10. Thus, the frame body 16 can be surely secured to the housing 10.

Furthermore, there is formed a crosspiece 26 at each of the four corners of the cover plate portion 23 in the hoop-shaped metallic plate as shown in FIG. 7. A cutting portion 27 for separating each crosspiece 26 and the frame body 16 is placed exactly on the rounded-off portions 10b or 10c. Accordingly, each crosspiece 26 does not restrict width sizes of the first and the second leg pieces 24, 25 of the frame body 16.

Figure 6:
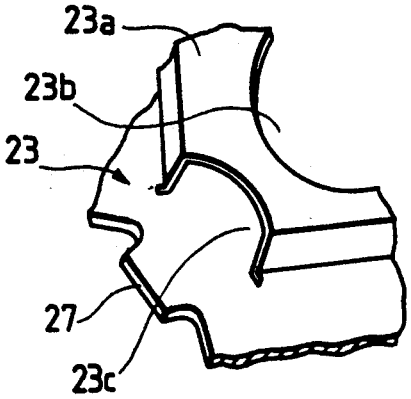
FIG. 6 is a perspective view showing an essential portion of a frame body adopted for the push button in accordance with the present invention.

Moreover, as apparent from FIGS. 1 and 6, the protruding portion 23a to be formed into the octagonal shape through the drawing process is formed as a cutout 23c at each of four corners in advance before drawing process. This cutout 23c is effective to prevent the cracking during the drawing process. That is, each corner was a trigger point of cracking. However, by providing the cutout 23c, cracking is surely prevented.

The push button switch constructed as explained above in the foregoing description can make the movable contact 13 generate a click feeling when the stem 15 is pushed down a predetermined amount. Subsequently, the movable contact 13 turns from side to side and contacts the central fixed contact 17. Through this movable contact 13, the central fixed contact 17 and the circumferential fixed contact 18 are associated so as to conduct electricity. Then, the switch is changed in condition from its OFF-condition to the ON-condition. Further, if the pushing force applied on the stem 15 is removed in this condition, the reversed movable contact 13 restores to the original dome-shape by virtue of its inherent spring nature. At this moment, the switch is again changed from the ON-condition to the OFF-condition. And, the stem 15 rises up to the position that the flange of the stem 15 is stopped by the protruding portion 23a of the frame body 16.

As is explained, according to above embodiment, the terminals 19 and 20 are provided so as to protrude from the rounded-off portions 10b, 10c. Thus, the longitudinal size of each belt-like metallic plate 11 or 12 molded in the housing 10 becomes shorter by the amount the planed-off portion 10b or 10c is retracted. For this arrangement, the likelihood that the belt-like metallic plates 11 and 12 are deformed by the resin pressure during its insertion molding process can be decreased. Therefore, it is surely possible to protrude the fixed terminals 17 and 18 a predetermined amount on the inner bottom surface of the housing 10.

In other words, even if the thicknesses of the belt-like metallic plates 11 and 12 are reduced in order to provide a compact push button switch, each belt-like metallic plate 11 or 12 having shorter longitudinal size is not weakened against a bending or torsion force. Therefore, there is provided a stronger structure capable of suppressing the fixed contacts 17 and 18 from being dislocated due to the resin pressure.

Furthermore, since the distance between the opposite distance-off portions 10b or 10c of the housing 10 is shorter than the distance between the opposite outer wall surfaces 10d of the housing 10, the maximum span of each belt-like metallic plate 11 or 12 is not so large compared to the maximum outer radius of the housing 10 measured in the same direction. Moreover, the terminals 19 and 20 have stepped portions 19a and 20a, respectively. These stepped portions 19a and 20a are formed by being bent along the rounded off portions 10b and 10c, respectively. It is possible not only to keep a minimum area necessary for soldering but also to reduce the projecting amount of each terminal 19 or 20. As a result, the maximum span of each belt-like metallic plate 11 or 12 can be further shortened.

Moreover, in above embodiment, the stem 15 is made of metal; i.e. not of resin material. Thus it is not necessary to pay attention to the difference of thermal expansion ratio or traces of injection gates compared with the conventional stem made of only synthetic resin material, the flange portion of the stem 15 can be manufactured into a thin flange. Further, compared to another conventional stem consisted of a combined metallic material and a synthetic resin material integrally molded through an insertion molding process, the stem 15 has a higher reliability. In addition, this stem 15 can be easily manufactured by pressing a pair of hard and soft metallic materials 21 and 22. Thus, this is preferable for the purpose of mass production of stems.

Yet further, in the above embodiment, the first leg piece 24 of the frame body 16 is bent along the outer wall surface 10d and the bottom surface of the housing 10. And further, the first leg piece 24 is provided the through hole 24a to facilitate folding operation of the first leg piece 24 at both sides of the through hole 24a without causing spring back phenomenon. Thus, the frame body 16 can be securely fixed to the housing 10 even if the push button switch is too small to apply a caulking fixation or a snap-in fixation.

And, the front end of the first leg piece 24 extending on the bottom surface of the housing 10 comes face to a printed substrate loading this push button switch. Therefore, it is easy to connect the front end of the first leg piece 24 on the circuit pattern of the printed substrate by means of soldering. Thus, the first leg piece 24 can be utilized as a ground terminal.

Still further, the frame body 16 is installed on the housing 10 by applying a bending operation, while four corners of the cover plate portion 23 are still connected with crosspieces 26 of the hooped-metallic plate. The first leg piece 24, the second leg piece 25, and the crosspiece 26 are arranged not to align together on one side of the cover plate portion 23. That is, crosspiece 26 is considered not to interfere with each leg piece 24 or 25. Thus, it becomes possible to design each leg piece 24 or 25 relatively wide in size, even though the push button switch so is an extremely small switch that is impossible to form the side of the cover plate portion 23 longer. Therefore, shortage of fixing area for the dust cover sheet 14 or lack of installation strength of the frame body 16 does not occur.

Furthermore, on the cover plate portion 23 of the frame body 16, there is provided a cutout 23c for preventing cracking. This cutout 23c is formed in advance before drawing processing for forming the protruding portion 23a. Thus, it becomes possible to improve yield rate, or to extend life of products.

Though, in the above embodiment, the housing 10 is an octagonal configuration when seen from the top and each terminal 19 or 20 protrudes from the planed-off portion 10*b* or 10*c* provided at each corner of the housing 10, the present invention is not limited to this embodiment. For example, the configuration of the housing can be hexagonal. And also, it is allowed to let the terminal protrude from only one rounded off portion of the outer wall surface of the housing.

Still further, though the above embodiment is explained based on the push button switch in which a stem is assembled in a protruding portion formed on a metallic frame body, the present invention can be also applied to a push button switch that has no protruding portion on a frame body.

In accordance with the present invention, the stem is made of two different kinds of metallic materials having different hardness. Such a stem can be easily manufactured by press processing. Thus, it is possible to reduce the flange thickness without lowering the productivity or the reliability of the stem. Thereby, the present invention contributes largely to realize a compact and thin push button switch.

As this invention may be embodied in several forms without departing from the spirit of essential characteristics thereof, the present embodiment is therefore illustrative and not restrictive, since the scope of the invention is defined by the appended claims rather than by this description, and all changes that fall within metes and bounds of the claims, or equivatents of such metes and bounds are therefore intended to embraced by the claims.

What is claimed is:

1. A push button switch comprising:

a housing having a main body defining an opening in an inner bottom surface therein;

a fixed contact exposed on the inner bottom surface;

a movable contact disposed to face said fixed contact;

a stem having a flange portion around the main body and being mounted on the housing movably in an up-and-down direction;

said movable contact contacting said fixed contact when said stem is lowered; and said stem being a first metallic material constituting said flange portion and a second metallic material constituting said main body.

2. A push button switch in accordance with claim 1, in which said first and second metallic materials are integrally press-formed.

3. A push button switch in accordance with claim 2, in which said second metallic material is of a softer material than is the first metallic material.

4. A push button switch in accordance with claim 3, in which said second metallic material is deformed by press operation so as to be integrated with the first metallic material.

5. A push button switch in accordance with claim 2, in which said first metallic material is stainless steel, and said second metallic material is brass.

6. A push button switch comprising:

a housing having a main body and defining an opening in an inner surface bottom therein;

a fixed contact exposed on the inner bottom surface;

a movable contact disposed to face said fixed contract;

a stem having a flange portion around the main body and being mounted on the housing movably in an up-and-down direction;

said movable contact contacting said fixed contact when said stem is lowered; and said stem being a first metallic material and a second metallic material, said first metallic material having a through hole surrounded by a tapered surface and chiefly constituting said flange portion, and said second metallic material being press-fitted into said through hole on the first metallic material so as to be press-fixed on the tapered surface of the first metallic material processing.

7. A push button switch in accordance with claim 6, in which said first metallic material is a stainless steel, and said second metallic material is brass.

* * * * *